US010716992B2

(12) United States Patent
Wu

(10) Patent No.: US 10,716,992 B2
(45) **Date of Patent: *Jul. 21, 2020**

(54) ADJUSTABLE SHOCK ABSORBER FOR INLINE SKATE

(71) Applicant: Anita Wu, Guangdong (CN)

(72) Inventor: Anita Wu, Guangdong (CN)

(73) Assignee: Dongguan Hongme: Sports Equipment Co., Ltd., Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,954

(22) Filed: Apr. 16, 2019

(65) Prior Publication Data

US 2019/0240561 A1 Aug. 8, 2019

(51) Int. Cl.
*A63C 17/00* (2006.01)
*A63C 17/06* (2006.01)

(52) U.S. Cl.
CPC ..... *A63C 17/0046* (2013.01); *A63C 17/065* (2013.01); *A63C 2203/20* (2013.01)

(58) Field of Classification Search
CPC ..... A63C 17/0046; A63C 17/065; A63C 2203/20; A63C 17/1436; A63C 17/062
See application file for complete search history.

(56) References Cited

U.S. PATENT DOCUMENTS 131,234 A * 9/1872 Todd ..... A63C 17/02 280/11.19
329,582 A * 11/1885 Miller ..... A63C 17/02 280/11.19
1,597,792 A * 8/1926 Hoff ..... A63B 25/10 280/11.14
1,603,529 A * 10/1926 Faust ..... A63C 17/22 280/11.19
1,934,535 A * 11/1933 Hast ..... A63C 17/02 280/11.26
2,557,331 A * 6/1951 Wintercorn ..... A63C 17/02 280/11.28
4,351,538 A * 9/1982 Berta ..... A63C 17/16 280/11.26
4,700,958 A * 10/1987 Volpato ..... A63C 17/045 280/842
5,405,156 A * 4/1995 Gonella ..... A63C 17/0046 280/11.225
5,582,418 A * 12/1996 Closser ..... A63C 17/0046 280/11.225
5,704,621 A * 1/1998 Lazarevich ..... A63C 17/0046 280/11.225
5,931,480 A * 8/1999 Schroeder ..... A63C 1/28 280/11.211
6,053,512 A * 4/2000 Chang ..... A63C 17/0046 280/11.231
6,065,759 A * 5/2000 Wu ..... A63C 17/0046 280/11.115

(Continued)

*Primary Examiner* — Jacob B Meyer

(57) ABSTRACT

An inline skate includes a skate boot; a front wheel mount secured to a front portion of a bottom of the skate boot; a front wheel rotatably secured to the front wheel mount; a rear wheel mount secured to a rear portion of the bottom of the skate boot; a rear wheel rotatably secured to the rear wheel mount; and two adjustable shock absorbers disposed between the front wheel mount and the rear wheel mount.

1 Claim, 3 Drawing Sheets

(56) References Cited

U.S. PATENT DOCUMENTS 6,116,619 A * 9/2000 Kao ..... A63C 17/062 280/11.19
6,149,167 A * 11/2000 Kao ..... A63C 17/0046 267/33
6,209,889 B1 * 4/2001 Alfieri ..... A63C 1/36 280/11.224
6,270,090 B1 * 8/2001 Gignoux ..... A63C 17/06 280/11.19
6,354,608 B1 * 3/2002 Syrkos ..... A63C 17/0046 280/11.225
6,454,280 B1 * 9/2002 Longino ..... A63C 17/0046 280/11.115
6,481,726 B2 * 11/2002 Alfieri ..... A63C 1/36 280/11.224
6,513,815 B2 * 2/2003 Glass ..... A63C 17/065 280/11.224
6,592,131 B1 * 7/2003 Bai ..... A63C 17/0046 280/11.224
6,644,673 B2 * 11/2003 Longino ..... A63C 17/0046 280/11.215
6,913,269 B2 * 7/2005 Wang ..... A63C 17/0046 280/11.225
7,048,281 B2 * 5/2006 Longino ..... A63C 17/0046 280/11.221
7,341,262 B2 * 3/2008 Liu ..... A63C 17/0046 280/11.19
7,621,541 B2 * 11/2009 Perkovich ..... A63C 17/062 280/11.231
2001/0030404 A1 * 10/2001 Liu ..... A63C 17/0046 280/87.041
2005/0051977 A1 * 3/2005 Yiu Lu ..... A63C 17/0086 280/11.26
2007/0132201 A1 * 6/2007 Bellehumeur ..... A63C 17/1418 280/87.041
2008/0067763 A1 * 3/2008 Zampieri ..... A63C 17/0046 280/11.224
2010/0320707 A1 * 12/2010 Chang ..... A63C 17/1454 280/11.225
2011/0079976 A1 * 4/2011 Seip ..... A63C 17/0046 280/87.042
2012/0261891 A1 * 10/2012 Oliveira ..... A63C 17/0046 280/11.28
2013/0277924 A1 * 10/2013 Ng ..... A63C 17/1409 280/11.214
2014/0034796 A1 * 2/2014 Hering ..... A63C 17/1427 248/231.71
2016/0038824 A1 * 2/2016 Choudhary ..... A63C 17/062 280/11.207
2016/0250545 A1 * 9/2016 Yurkin ..... A63C 17/008 280/11.223
2016/0296828 A1 * 10/2016 Ewing, Jr. ..... A63C 17/1427
2018/0028899 A1 * 2/2018 Chen ..... A63C 17/0046
2018/0243637 A1 * 8/2018 Jon ..... A63C 17/008
2018/0326293 A1 * 11/2018 Wu ..... A63C 17/0046

* cited by examiner

ADJUSTABLE SHOCK ABSORBER FOR INLINE SKATE

BACKGROUND OF THE INVENTION

1. Field of the Invention

The invention relates to inline skates and more particularly to an inline skate having an adjustable shock absorber.

2. Description of Related Art

Conventionally, no shock absorber is provided by an inline skate. Thus, shock and jarring of the inline skates are increased greatly when an individual wears the inline skates to move quickly across a surface with irregularities. This can decrease skating speed and cause pain to the user's knees and other parts of the legs.

Thus, the need for improvement still exists.

SUMMARY OF THE INVENTION

It is therefore one object of the invention to provide an inline skate comprising a skate boot; a front wheel mount secured to a front portion of a bottom of the skate boot; a front wheel rotatably secured to the front wheel mount; a rear wheel mount secured to a rear portion of the bottom of the skate boot; a rear wheel rotatably secured to the rear wheel mount; and two shock absorbers disposed between the front wheel mount and the rear wheel mount.

The above and other objects, features and advantages of the invention will become apparent from the following detailed description taken with the accompanying drawings.

DETAILED DESCRIPTION OF THE INVENTION

Figure 1:
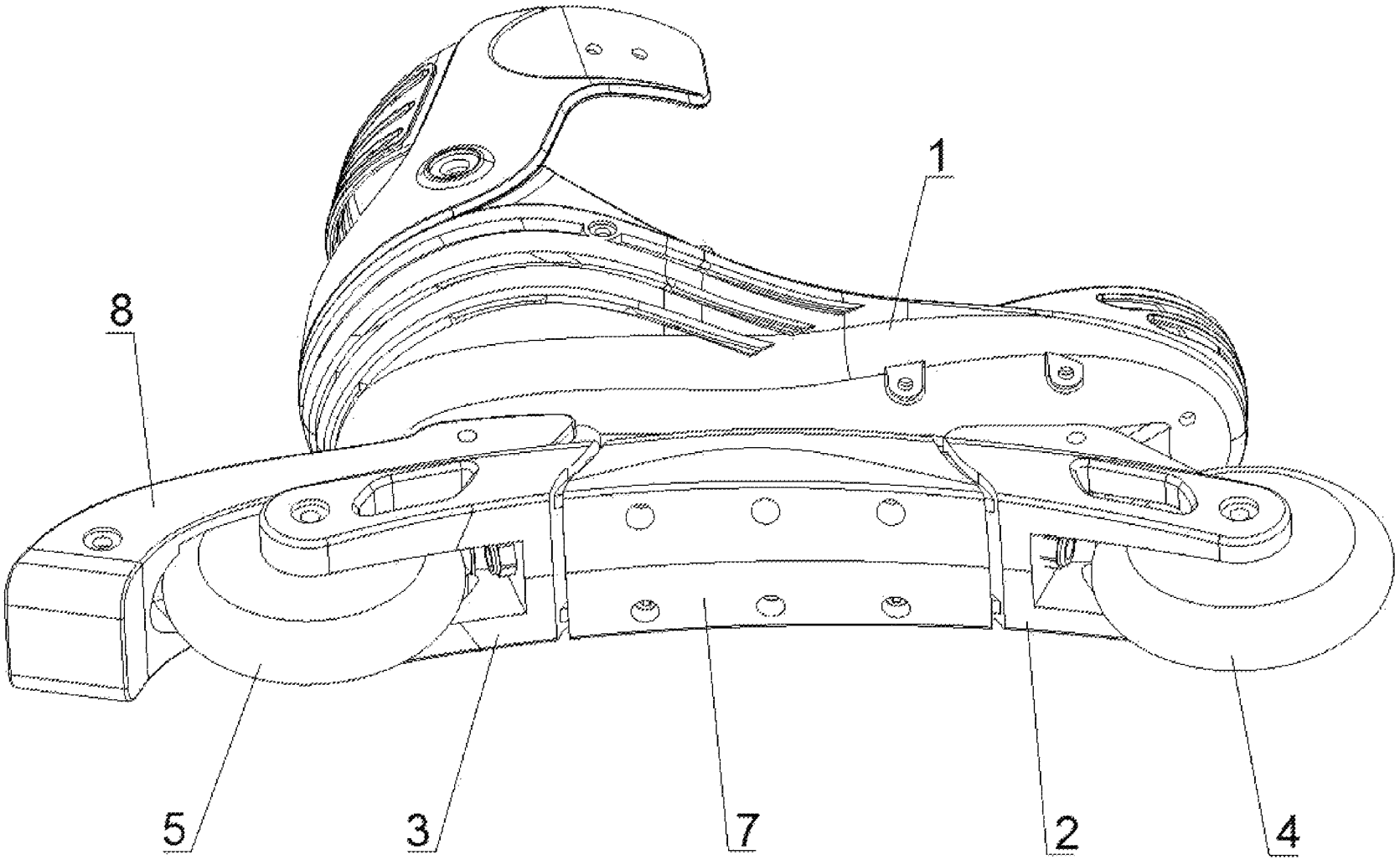
FIG. 1 is a perspective view of an inline skate of the invention.
Figure 2:
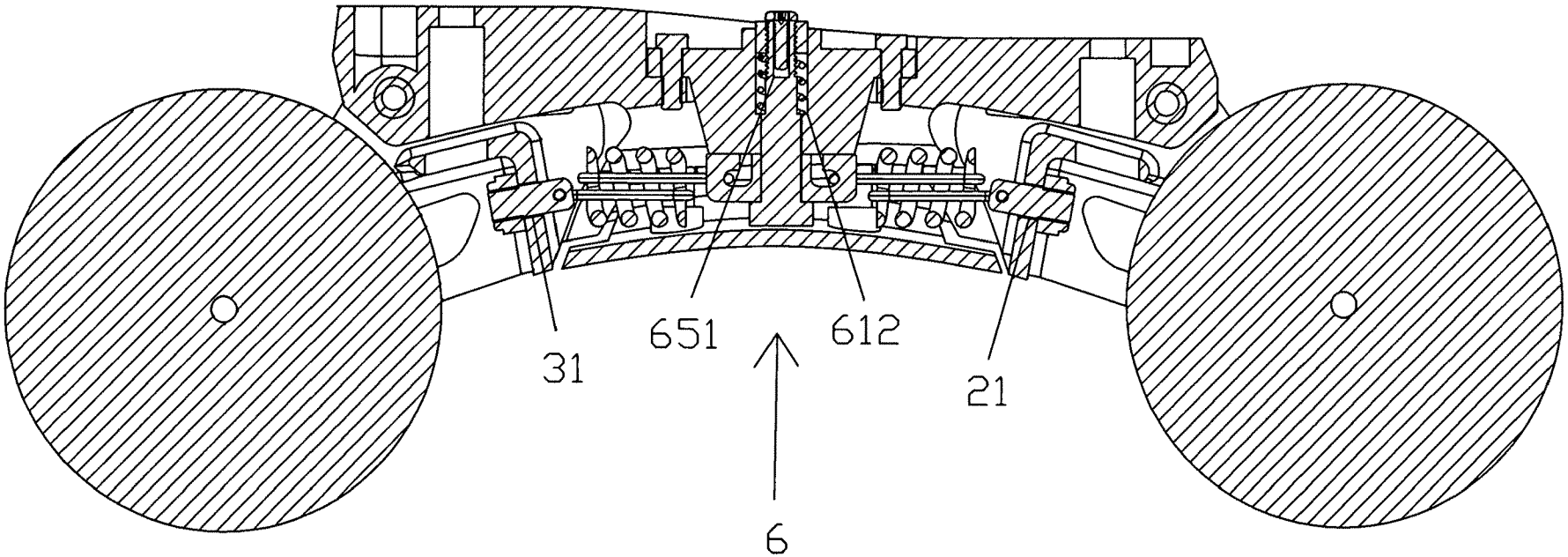
FIG. 2 is a view similar to FIG. 1 with the protective member removed.
Figure 3:
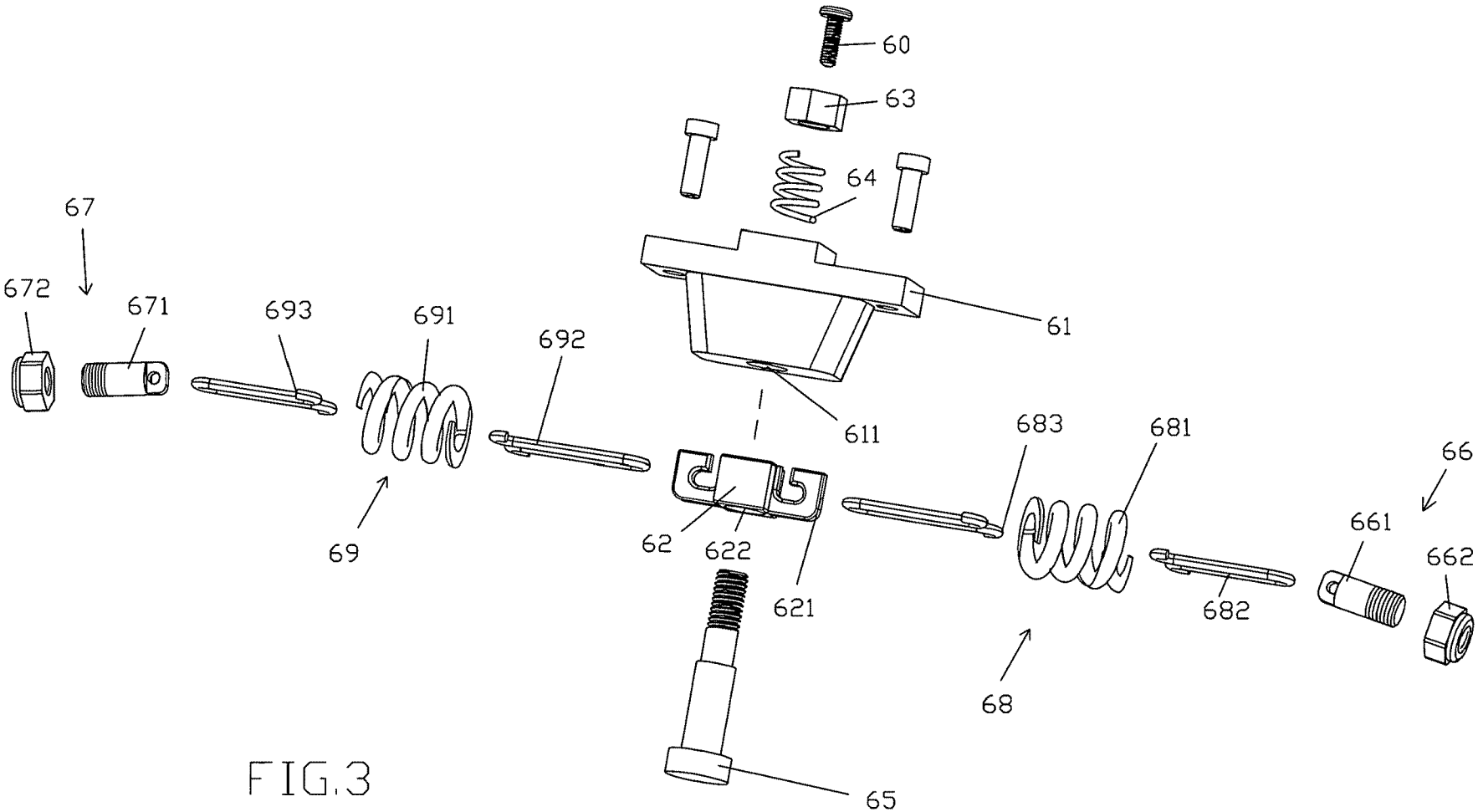
FIG. 3 is an exploded view of FIG. 2 showing components of the shock absorber.

Referring to FIGS. 1 to 3, an inline skate of the invention comprises a skate boot 1, a front wheel mount 2 secured to a front portion of a bottom of the skate boot 1, a front wheel 4 rotatably secured to the front wheel mount 2, a rear wheel mount 3 secured to a rear portion of a bottom of the skate boot 1, a rear wheel 5 rotatably secured to the rear wheel mount 3, a shock absorber 6 disposed between the front wheel mount 2 and the rear wheel mount 3, a protective member 7 mounted on the shock absorber 6, and a brake block 8 attached to a rear end of the skate boot 1 with both the rear wheel mount 3 and the rear wheel 5 disposed below.

The shock absorber 6 comprises a positioning member 61 secured to the skate boot 1 and including a stepped-diameter passageway 611; a suspension member 62 including two hook elements 621 on front and rear ends respectively and an intermediate channel 622; a nut 63 disposed in the passageway 611; a main expansion spring 64 biased between the nut 63 and a shoulder 612 of the passageway 611; a main threaded member 65 including an internally threaded hole 651 at an end and passing through the channel 622, the passageway 611 and the main expansion spring 64 to secure to the nut 63; a bolt 60 driven into the internally threaded hole 651 to position the nut 63, the positioning member 61, the suspension member 62 and the main threaded member 65; a first adjustment screw assembly 66 including a threaded element 661 driven through a threaded hole 21 in the front wheel mount 2, and an adjustment screw 662 secured to the threaded element 661; a second adjustment screw assembly 67 including a threaded element 671 driven through a threaded hole 31 in the rear wheel mount 3, and an adjustment screw 672 secured to the threaded element 671; a first biasing assembly 68 including a torsion spring 681, a first bow-shaped hook 682 disposed through the torsion spring 681 and having one end secured to an end of the threaded element 661 and the other two hooked ends secured to one end of the torsion spring 681, and a second bow-shaped hook 683 disposed through the torsion spring 681 and having one end secured to the front one of the hook elements 621 and the other two hooked ends secured to the other end of the torsion spring 681; and a second biasing assembly 69 including a torsion spring 691, a first bow-shaped hook 693 disposed through the torsion spring 691 and having one end secured to an end of the threaded element 671 and the other two hooked ends secured to one end of the torsion spring 691, and a second bow-shaped hook 692 disposed through the torsion spring 691 and having one end secured to the rear one of the hook elements 621 and the other two hooked ends secured to the other end of the torsion spring 691.

For adjusting damping force of the shock absorber 6 in a horizontal direction, a rear portion of the shock absorber 6 will be taken as an example in the following discussion.

An individual may use one hand to clockwise rotate the adjustment screw 672. And in turn, the first bow-shaped hook 693 is pulled toward the rear wheel mount 3. Thus, the torsion spring 691 is compressed. Thus, a damping force of the shock absorber 6 in the horizontal direction is increased.

To the contrary, the user may use one hand to counter-clockwise rotate the adjustment screw 672. And in turn, the first bow-shaped hook 693 is pulled away from the rear wheel mount 3. Thus, the torsion spring 691 is expanded. Thus, a damping force of the shock absorber 6 in the horizontal direction is decreased.

It is envisaged by the invention that in response to encountering irregularities on the ground, shocks transmitted through the front wheel 4 and/or rear wheel 5 will be absorbed by the suspension member 62, the first biasing assembly 68, the second biasing assembly 69, and the main expansion spring 64.

For adjusting damping force of the shock absorber 6 in a vertical direction, an intermediate portion of the shock absorber 6 will be taken as an example in the following discussion.

An individual may use one hand to clockwise rotate the main threaded member 65. And in turn, the main expansion spring 64 is further compressed. Thus, a damping force of the shock absorber 6 in the vertical direction is increased.

To the contrary, the user may use one hand to counter-clockwise rotate the main threaded member 65. And in turn, the main expansion spring 64 is expanded. Thus, a damping force of the shock absorber 6 in the vertical direction is decreased.

While the invention has been described in terms of preferred embodiments, those skilled in the art will recognize that the invention can be practiced with modifications within the spirit and scope of the appended claims.

What is claimed is:

1. An inline skate, comprising:

a skate boot;

a front wheel mount secured to a front portion of a bottom of the skate boot;

a front wheel rotatably secured to the front wheel mount;

a rear wheel mount secured to a rear portion of the bottom of the skate boot;

a rear wheel rotatably secured to the rear wheel mount; and a shock absorber disposed between the front wheel mount and the rear wheel mount and comprising a positioning member secured to the skate boot and including a stepped-diameter passageway; a suspension member including two hook elements on front and rear ends respectively and an intermediate channel; a nut disposed in the passageway; a main expansion spring biased between the nut and a shoulder of the passageway; a main threaded member including an internally threaded hole at an end and passing through the channel, the passageway, and the main expansion spring to secure to the nut; a bolt driven into the internally threaded hole to position the nut, the positioning member, the suspension member, and the main threaded member; a first adjustment screw assembly including a first threaded element driven through a threaded hole in the front wheel mount, and a first adjustment screw secured to the first threaded element; a second adjustment screw assembly including a second threaded element driven through a threaded hole in the rear wheel mount, and a second adjustment screw secured to the second threaded element; a first biasing assembly including a first torsion spring, a first bow-shaped hook disposed through the first torsion spring and having one end secured to an end of the first threaded element and the other end comprising two first hooked ends secured to one end of the first torsion spring, and a second bow-shaped hook disposed through the first torsion spring and having one end secured to the front one of the hook elements and the other end comprising first hooked ends secured to the other end of the first torsion spring; and a second biasing assembly including a second torsion spring, a first bow-shaped hook disposed through the second torsion spring and having one end secured to an end of the second threaded element and the other end comprising two second hooked ends secured to one end of the second torsion spring, and a second bow-shaped hook disposed through the second torsion spring and having one end secured to the rear one of the hook elements and the other end comprising second hooked ends secured to the other end of the second torsion spring.

* * * * *